US009494314B2

(12) United States Patent
Oglesby et al.

(10) Patent No.: US 9,494,314 B2
(45) Date of Patent: Nov. 15, 2016

(54) GAS POWERED HEATING UNIT AND A HEAT NOT BURN VAPORISING DEVICE

(71) Applicant: OGLESBY & BUTLER RESEARCH & DEVELOPMENT LIMITED, Carlow (IE)

(72) Inventors: Alfred Peter Oglesby, Carlingford (IE); John Paul Oglesby, Carlow (IE)

(73) Assignee: OGLESBY & BUTLER RESEARCH & DEVELOPMENT LIMITED, Carlow (IE)

( * ) Notice: Subject to any disclaimer, the term of this patent is extended or adjusted under 35 U.S.C. 154(b) by 0 days.

(21) Appl. No.: 14/561,608

(22) Filed: Dec. 5, 2014

(65) Prior Publication Data

US 2015/0083149 A1 Mar. 26, 2015

Related U.S. Application Data

(63) Continuation of application No. 12/675,619, filed as application No. PCT/IE2008/000081 on Aug. 28, 2008, now abandoned.

(30) Foreign Application Priority Data

Aug. 28, 2007 (IE) ..... S2007/0612

(51) Int. Cl.

| | |
|---|---|
| ***F24C 1/00*** | (2006.01) |
| ***A24F 13/00*** | (2006.01) |
| ***F23C 6/04*** | (2006.01) |
| ***A24F 47/00*** | (2006.01) |
| ***F23C 13/00*** | (2006.01) |

(52) U.S. Cl.

CPC ..... *F23C 6/04* (2013.01); *A24F 47/006* (2013.01); *F23C 13/00* (2013.01)

(58) Field of Classification Search

CPC ..... F23C 13/02; F23C 13/04; F23C 13/06
USPC ..... 126/226–241, 401–414; 431/268
See application file for complete search history.

(56) References Cited

U.S. PATENT DOCUMENTS

| | | | | |
|---|---|---|---|---|
| 2,029,604 A | | 2/1936 | Bayer et al. | |
| 3,421,859 A | * | 1/1969 | Kruggel | A01G 7/02 422/120 |
| 4,635,382 A | * | 1/1987 | Bourdeau | A45D 20/06 126/401 |
| 5,938,427 A | * | 8/1999 | Suzuki | F23C 6/04 431/11 |
| 7,488,171 B2 | * | 2/2009 | St. Charles | F23D 14/105 431/329 |

FOREIGN PATENT DOCUMENTS

| | | | | |
|---|---|---|---|---|
| EP | 0716263 A2 | | 6/1996 | |
| EP | 0962697 A2 | | 12/1999 | |
| IE | WO 2006082571 A1 | * | 8/2006 | A61M 11/047 |
| JP | 03-241213 A | | 10/1991 | |
| WO | 2006/082571 A1 | | 8/2006 | |

* cited by examiner

*Primary Examiner* — Avinash Savani
*Assistant Examiner* — Vivek Shirsat
(74) *Attorney, Agent, or Firm* — Sughrue Mion, PLLC

(57) ABSTRACT

A vaporizing device (80) for vaporizing vaporizable matter without burning the vaporizable matter, typically, tobacco, comprises a vaporization chamber (61) for the vaporizable matter, and a gas powered heating unit (1) for heating the vaporization chamber (61). The heating unit (1) comprises a housing (2) having a main cylindrical side wall (4) closed at its respective ends by a first end wall (5) and a second end wall (6) to form a main chamber (8) within which fuel gas is converted to heat. A secondary cylindrical side wall (62) extends from the second end wall (6) to form the vaporization chamber (61) for receiving a tobacco product (81), a cylindrical sleeve (83) of tobacco (84) for producing an aerosol of vaporizable constituents in the tobacco (84). A cylindrical partition wall (10) concentric with the main side wall (4) of the housing (2) extends into the main chamber (8) from the first end wall (5) and defines a primary combustion chamber (11) and a secondary combustion chamber (12). A cylindrical primary gas catalytic combustion element (13) is located in the primary combustion chamber (11), and a cylindrical secondary gas catalytic combustion element (14) is located in the secondary combustion chamber (12). A fuel gas/air mixture is delivered into the primary combustion chamber (11) through a fuel gas inlet (17) in the first end wall (5) for conversion to heat by the primary gas catalytic combustion element (13). Exhaust gases with entrained unburnt fuel gas from the primary combustion chamber (11) pass into the secondary combustion chamber (12) where remaining unburnt fuel gas is converted to heat by the secondary gas catalytic combustion element (14). An exhaust gas outlet (18) through the main side wall (4) accommodates exhaust gases from the secondary combustion chamber (12).

21 Claims, 7 Drawing Sheets

GAS POWERED HEATING UNIT AND A HEAT NOT BURN VAPORISING DEVICE

Figure 1:
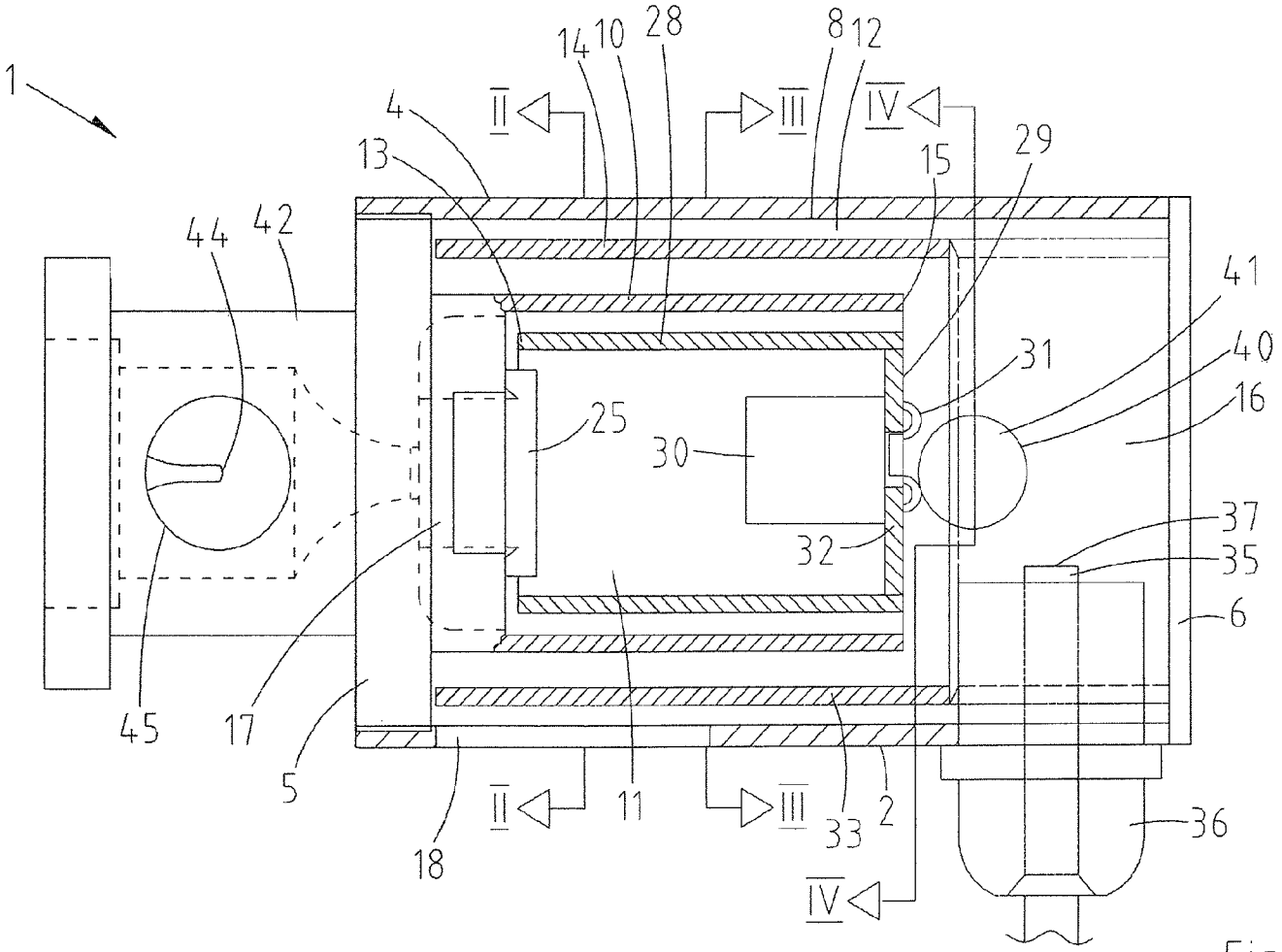

This application is a continuation of U.S. application Ser. No. 12/675,619 filed Feb. 26, 2010, which application is a National Stage Under §371 of PCT International Application No. PCT/IE2008/00081 filed Aug. 28, 2008, which claims priority from Ireland Application No. S2007/0612 filed Aug. 28, 2007, the entire disclosures of which are hereby incorporated in their entirety.

The present invention relates to a gas powered heating unit, and in particular, though not limited to a gas powered heating unit for use in, for example, a soldering iron, a glue gun, a vaporising device, such as a heat not burn vaporiser for vaporising vaporisable matter, which may comprise one or more flavour constituents, medicinal constituents and/or psychoactive constituents, for example, tobacco, mullein, passion flower, cloves, yohimbe, mint, tea, eucalyptus, camomile and other such herb and plant matter, although needless to say, the gas powered heating unit is not limited to such uses. The invention also relates to a vaporising device and in particular a heat not burn vaporising device for vaporising vaporisable matter.

Gas powered heating units are known, and such gas powered heating units typically are used for heating a soldering tip of a soldering iron, typically, a portable soldering iron, a glue gun, a vaporising device and the like. Such gas powered heating units used for heating soldering irons, glue guns and vaporising devices are disclosed in European Patent Specification No. 0,118,282, and PCT Published Application Specifications Nos. WO 2006/082571, WO 2006/033091 and WO 01/07173. However, in the case of soldering irons, glue guns and vaporising devices, particularly such devices which are provided as portable devices, miniaturisation of the devices is essential, and thus, it is important that all component parts of such soldering irons, glue guns and vaporising devices are miniaturised. Accordingly, it is desirable that the gas powered heating unit of such devices operates as efficiently as possible in order to maximise miniaturisation thereof.

The present invention is directed towards providing a gas powered heating unit with improved conversion efficiency. The invention is also directed towards a vaporising device, such as a heat not burn vaporising device for vaporising vaporisable matter.

According to the invention there is provided a gas powered heating unit comprising a housing of heat conductive material defining:

a first catalytic combustion chamber, and a second catalytic combustion chamber, wherein the first catalytic combustion chamber is configured to receive fuel and to communicate the fuel with the second catalytic combustion chamber for conversion to heat.

Preferably, the first catalytic combustion chamber comprises a first catalytic element. Advantageously, the first catalytic element is configured to define two catalytic surfaces. Ideally, the first catalytic combustion chamber comprises two fuel flow passages formed by the catalytic surfaces of the first catalytic element.

Preferably, the first catalytic element is formed as a cylindrical element within the first catalytic combustion chamber. Advantageously, the first catalytic element is a hollow element. Ideally, the first catalytic element comprises a carrier of perforated metal.

Preferably, the carrier of the first catalytic element is of sheet metal.

In one embodiment of the invention the carrier of the first catalytic element is configured to form a hollow cylinder.

In another embodiment of the invention the carrier of the first catalytic element comprises a material selected from one or more of the following materials or alloys thereof:

stainless steel, aluminium, ceramics, silica, and carbon.

Preferably, the carrier of the first catalytic element is coated with a catalytic material. Advantageously, the catalytic material coated onto the carrier of the first catalytic element comprises a precious metal.

In one embodiment of the invention the second catalytic combustion chamber comprises a second catalytic element. Preferably, the second catalytic element is configured to define two catalytic surfaces. Advantageously, the second catalytic combustion chamber comprises two fuel flow passages formed by the catalytic surfaces of the second catalytic element. Preferably, the second catalytic element is formed as a cylindrical element within the second catalytic combustion chamber. Advantageously, the second catalytic element is a hollow element. Ideally, the second catalytic element comprises a carrier of perforated metal.

Preferably, the carrier of the second catalytic element is of sheet material.

In one embodiment of the invention the carrier of the second catalytic element is configured to form a hollow cylinder. In another embodiment of the invention the carrier of the second catalytic element comprises a material selected from one or more of the following materials or alloys thereof:

stainless steel, aluminium, ceramics, silica, and carbon.

In another embodiment of the invention the carrier of the second catalytic element is coated with a catalytic material. Advantageously, the catalytic material coated onto the carrier of the second catalytic element is a precious metal.

Preferably, the second catalytic combustion chamber is configured to extend around the first catalytic combustion chamber.

Advantageously, the first and second catalytic combustion chambers are concentric with each other. Preferably, the first catalytic combustion chamber is cylindrical.

In one embodiment of the invention one of the first and second catalytic combustion chambers includes a thermal mass.

In a further embodiment of the invention the gas powered heating unit further comprises a temperature regulating valve configured to dispense fuel so as to maintain the housing within a predefined temperature range.

Advantageously, the housing further defines a flame combustion chamber. Preferably, the flame combustion chamber communicates the second catalytic combustion chamber with the first catalytic combustion chamber.

In one embodiment of the invention a fuel gas inlet is provided to the first catalytic combustion chamber, and a fuel gas outlet is provided from the second catalytic combustion chamber, the fuel gas inlet and the exhaust gas outlet being disposed relative to the first and second catalytic combustion chambers so that fuel gas flows initially through the first catalytic combustion chamber, where at least some of the fuel gas is converted to heat, and exhaust gases resulting from conversion in the first catalytic combustion chamber and unburned fuel gas from the first catalytic combustion chamber flow through the second catalytic combustion chamber.

Preferably, the exhaust gas outlet is located relative to the second catalytic combustion chamber to maximise contact of unburned fuel gas from the first catalytic combustion chamber with the second catalytic element. Advantageously, the fuel gas inlet is located relative to the first catalytic combustion chamber to maximise contact of fuel gas with the first catalytic element.

Preferably, the housing comprises a main side wall extending around and defining a main chamber within which the first and second catalytic combustion chambers are formed, the side wall extending between a first end wall closing one end of the main chamber, and the second end wall closing the other end of the main chamber.

Advantageously, the first end wall defines an upstream end of the first catalytic combustion chamber, and a downstream end of the second catalytic combustion chamber.

Ideally, a partition element is located in the main chamber dividing the main chamber into the first catalytic combustion chamber and the second catalytic combustion chamber.

Preferably, the partition element extends from the first end wall, and advantageously, the partition element terminates in a distal end in the main chamber at a location spaced apart from the second end wall for facilitating communication of the second catalytic combustion chamber with the first catalytic combustion chamber.

In one embodiment of the invention the partition element comprises a partition wall extending within the main chamber concentrically with the main side wall and spaced apart therefrom so that the first catalytic combustion chamber is formed within the partition wall, and the second catalytic combustion chamber is formed between the partition wall and the main side wall.

Preferably, the fuel gas inlet is located in the first end wall, and advantageously, the exhaust gas outlet is located in the main side wall adjacent the first end wall.

Preferably, the flame combustion chamber is defined between the second end wall and the distal end of the partition element.

In one embodiment of the invention at least one of the first and second catalytic elements is disposed relative to the flame combustion chamber so that as fuel gas is initially burnt in a flame in the flame combustion chamber the flame raises the temperature of the one of the first and second catalytic elements to its ignition temperature, and the flame is extinguished as a result of fuel gas conversion to heat by the said one of the first and second catalytic elements. Preferably, the first catalytic element is located relative to the flame combustion chamber so that the flame raises the temperature of the first catalytic element to its ignition temperature. Advantageously, a perforated end cap coated with a gas catalytic material extends transversely across the first catalytic element adjacent the flame combustion chamber.

In one embodiment of the invention the first catalytic element is located relative to the fuel gas inlet to act as a barrier to prevent blow-back of a flame from the flame combustion chamber through the fuel gas inlet.

In another embodiment of the invention the second catalytic element is located relative to the exhaust gas outlet to act as a barrier to prevent blow-out of a flame from the flame combustion chamber through the exhaust gas outlet.

Preferably, the partition wall is a cylindrical partition wall. Advantageously, the main side wall of the housing is a cylindrical side wall.

In another embodiment of the invention the thermal mass is associated with at least one of the first and second catalytic elements for maintaining a portion of the at least one of the first and second catalytic elements with which the thermal mass is associated at or above its ignition temperature adjacent the thermal mass during short periods of fuel gas interruption, so that when fuel gas is re-established, the one of the first and second catalytic elements adjacent the thermal mass commences to convert the fuel gas to heat. Preferably, the thermal mass is associated with the first catalytic element. Advantageously, the thermal mass is secured to a portion of the first catalytic element.

In another embodiment of the invention the housing is adapted for coupling to an accessory to be heated by the heating unit. The accessory may be a soldering tip of a soldering iron, a heater element of a glue gun for heating glue, a pressing plate of a clothes pressing iron, a vaporisation chamber for vaporising vaporisable matter therein, such as a heat not burn vaporising device.

The invention also provides a vaporising device comprising the gas powered heating unit according to the invention, and a vaporisation chamber for holding a vaporisable material configured to release an aerosol when heated, the vaporisation chamber being in heat transfer relationship with the housing of the heating unit.

The invention also provides a vaporising device comprising a housing that defines:

- a vaporisation chamber for holding a vaporisable material configured to release an aerosol when heated,
- a first catalytic combustion chamber,
- a second catalytic combustion chamber,
- wherein the first catalytic combustion chamber is configured to receive fuel gas and communicate the fuel gas with the second catalytic combustion chamber for conversion to heat.

Preferably, the vaporisation chamber is coaxial with the first and second catalytic combustion chambers. Advantageously, the vaporisation chamber is formed by a secondary side wall extending from the second end wall. Ideally, the secondary side wall is configured as a cylindrical side wall.

In one embodiment of the invention a heat exchange spindle extends into the vaporisation chamber. Preferably, the heat exchange spindle extends from the second end wall.

In another embodiment of the invention the vaporising device further comprises a vaporisation module, wherein the module is configured as one of loose tobacco, tobacco flakes, a tobacco sachet and a cartridge comprising a matrix infused with nicotine.

In another embodiment of the invention the vaporising device further comprises a hollow cylindrical plug member for engaging the vaporisation chamber. Preferably, the plug member includes an axial mouthpiece extension.

In another embodiment of the invention the vaporisation chamber is configured to engage a tobacco product configured with tobacco. Preferably, the tobacco product is configured with a filter mouthpiece extension.

In a further embodiment of the invention the vaporising device is configured as a heat not burn vaporising device.

The invention also provides a vaporising device comprising a heatable housing that defines:

- a vaporisation chamber for holding a vegetable material configured to release an aerosol when heated, a first flame combustion chamber, a first catalytic combustion chamber, a second catalytic combustion chamber, wherein the first catalytic combustion chamber is configured to receive fuel and to communicate the fuel with the second catalytic combustion chamber for conversion to heat.

The advantages of the invention are many. A particularly important advantage of the invention is that it provides a particularly efficient gas powered heating unit which has a particularly high conversion efficiency for converting fuel gas to heat. Because of the relatively high efficiency achieved by the heating unit according to the invention, the heating unit is particularly suitable for miniaturisation, and is thus particularly suitable for use in vaporising devices for vaporising vaporisable matter, as well as in soldering irons, glue guns and the like. These advantages are largely achieved by configuring first and second catalytic combustion chambers so that fuel gas is received by the first catalytic combustion chamber, and exhaust gases with entrained unburnt fuel gas from the first catalytic combustion chamber passes through the second catalytic combustion chamber, where the entrained unburnt fuel gas is converted to heat and exhausted along with the exhaust gases from the first catalytic combustion chamber. By configuring the fuel gas inlet and the exhaust gas outlet so that the area of contact between the fuel gas and the first catalytic element and the second catalytic element is maximised, maximum heat conversion efficiency from the fuel gas is achieved. By configuring the first and second catalytic elements in the respective first and second catalytic combustion chambers so that the first and second catalytic elements define two fuel gas passageways through the respective first and second catalytic combustion chambers, efficiency of conversion of fuel gas to heat is further enhanced. Performance characteristics are further enhanced by implementing perforated catalytic elements. As such, the fuel gas may flow across both inner and outer catalytic element surfaces as well as through the perforated catalytic element itself.

By locating the first and second catalytic combustion chambers concentrically relative to each other, so that the second catalytic combustion chamber extends around the first catalytic combustion chamber, miniaturisation of the gas powered heating unit is achieved. Thus, when the gas powered heating unit is used as a heat source for a vaporising device such as a heat not burn vaporising device, significant miniaturisation of such devices is achieved.

A further advantage of the invention is achieved by the provision of the thermal mass for maintaining an adjacent portion of one of the first and second catalytic elements at the ignition temperature of the catalytic element during relatively short periods of fuel gas interruption. By maintaining the catalyst portion adjacent the thermal mass of the first or second catalytic element at the ignition temperature during periods of fuel gas interruption, when the supply of fuel gas is re-established, conversion of the fuel gas to heat by the portion of the first or second catalytic element at its ignition temperature immediately commences, and thus the remainder of the first or second catalytic element is readily brought to its ignition temperature for full catalytic conversion of the fuel gas by that catalytic element. The arrangement of the first catalytic element with the thermal mass secured to the downstream end thereof provides a particularly advantageous construction of the first catalytic element with the thermal mass.

Additionally, by configuring the first catalytic element with a downstream end cap formed from catalytic element material facilitates ignition of the gas powered heating unit, in that initial flame combustion of the fuel gas in the flame combustion chamber raises the temperature of the end cap of the first catalytic element to its ignition temperature, so that conversion of the fuel gas to heat by catalytic action is initiated in the first catalytic element, which in turn extinguishes the flame as a result of fuel gas starvation.

Figure 2:
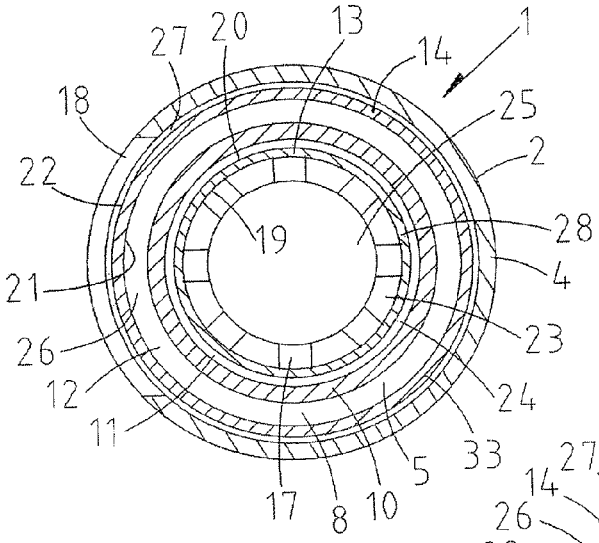
Figure 4:
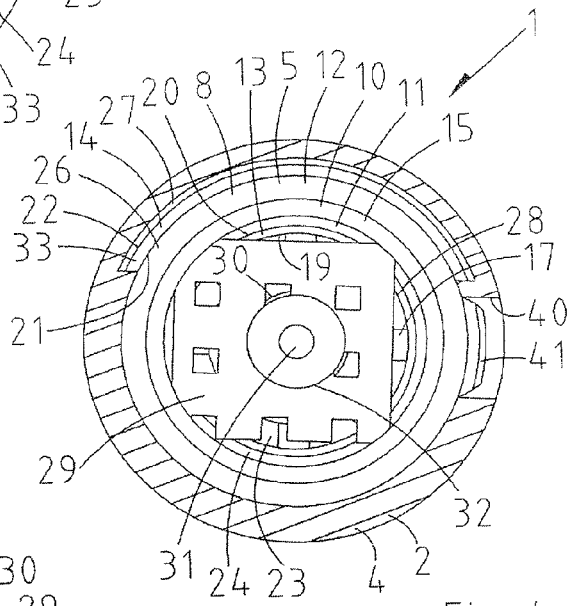
Figure 3:
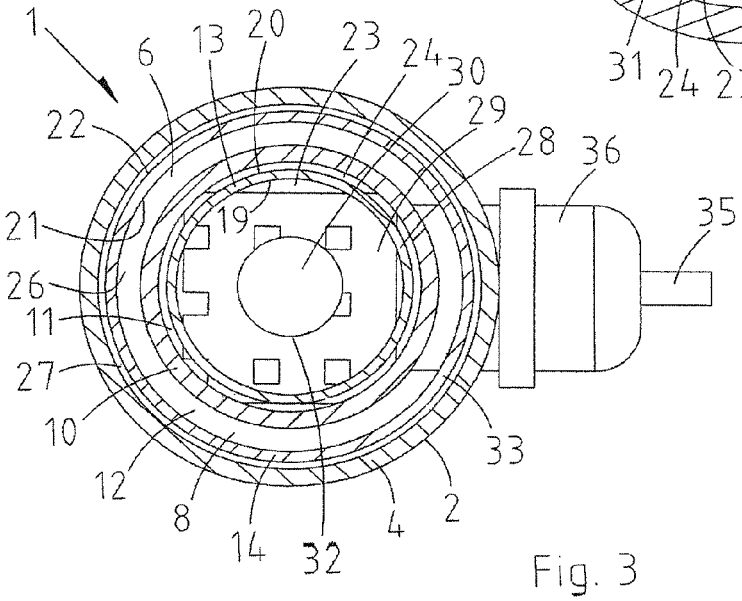
Figure 5:
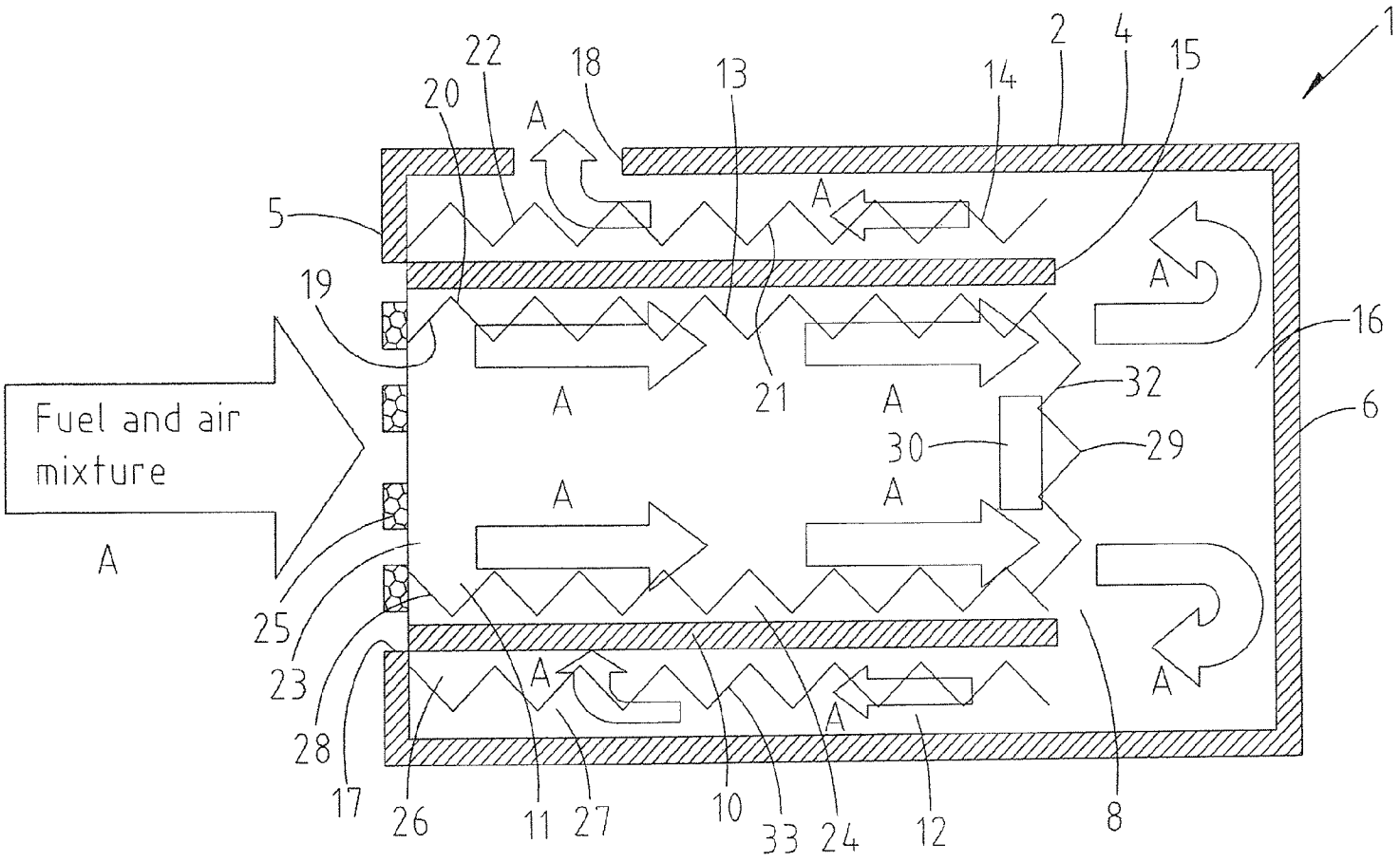
Figure 6:
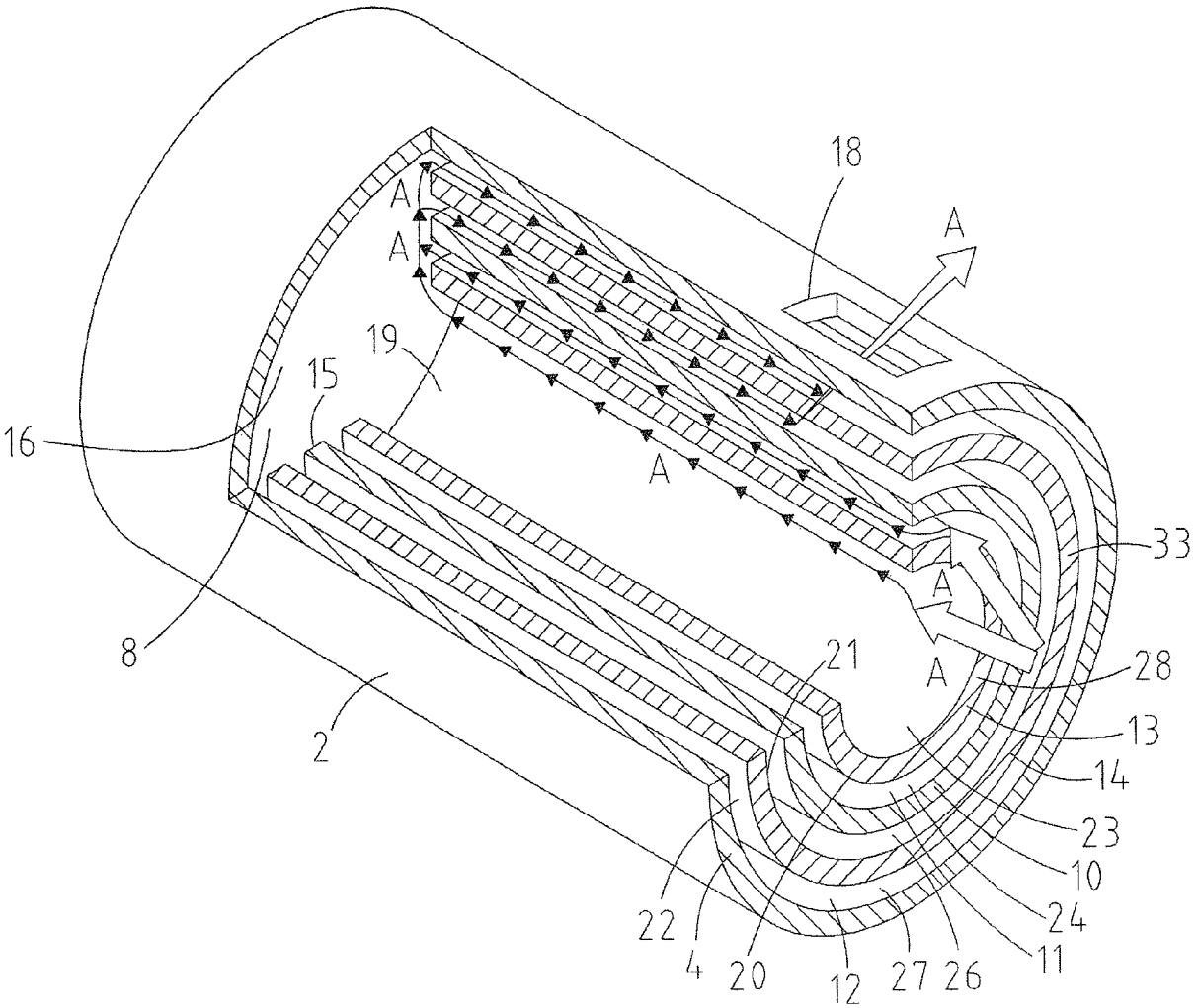
Figure 9:
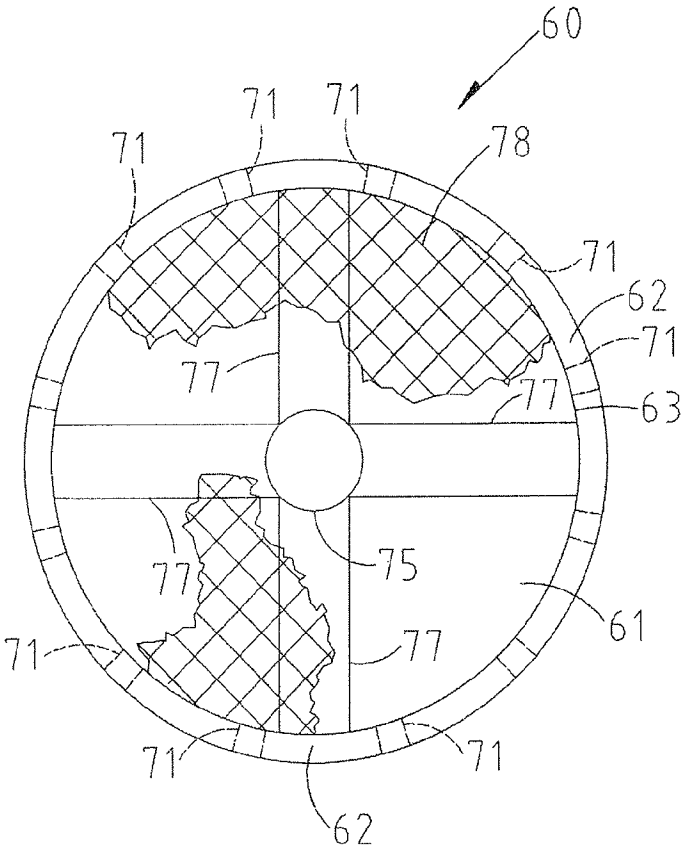
Figure 7:
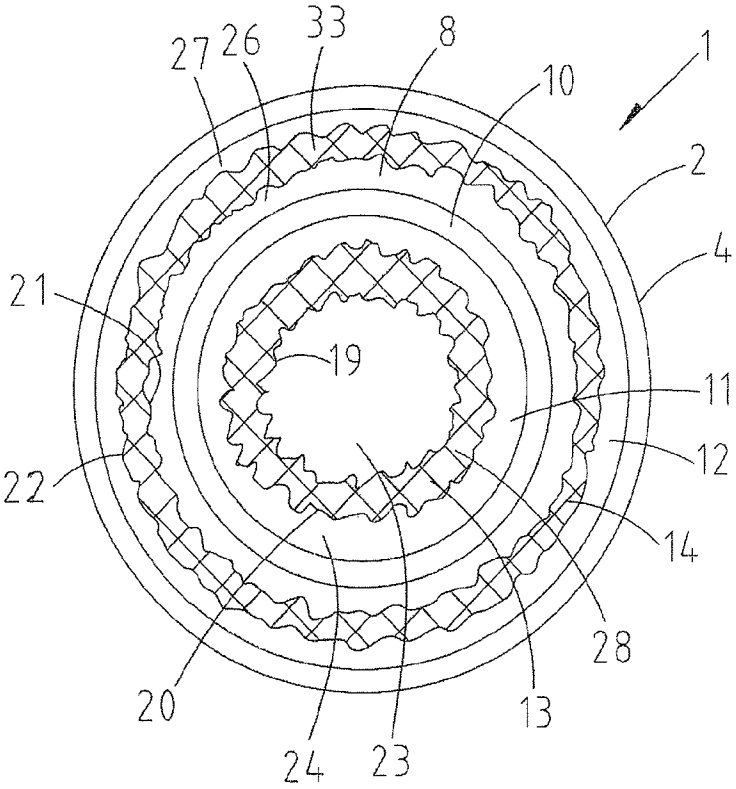
Figure 8:
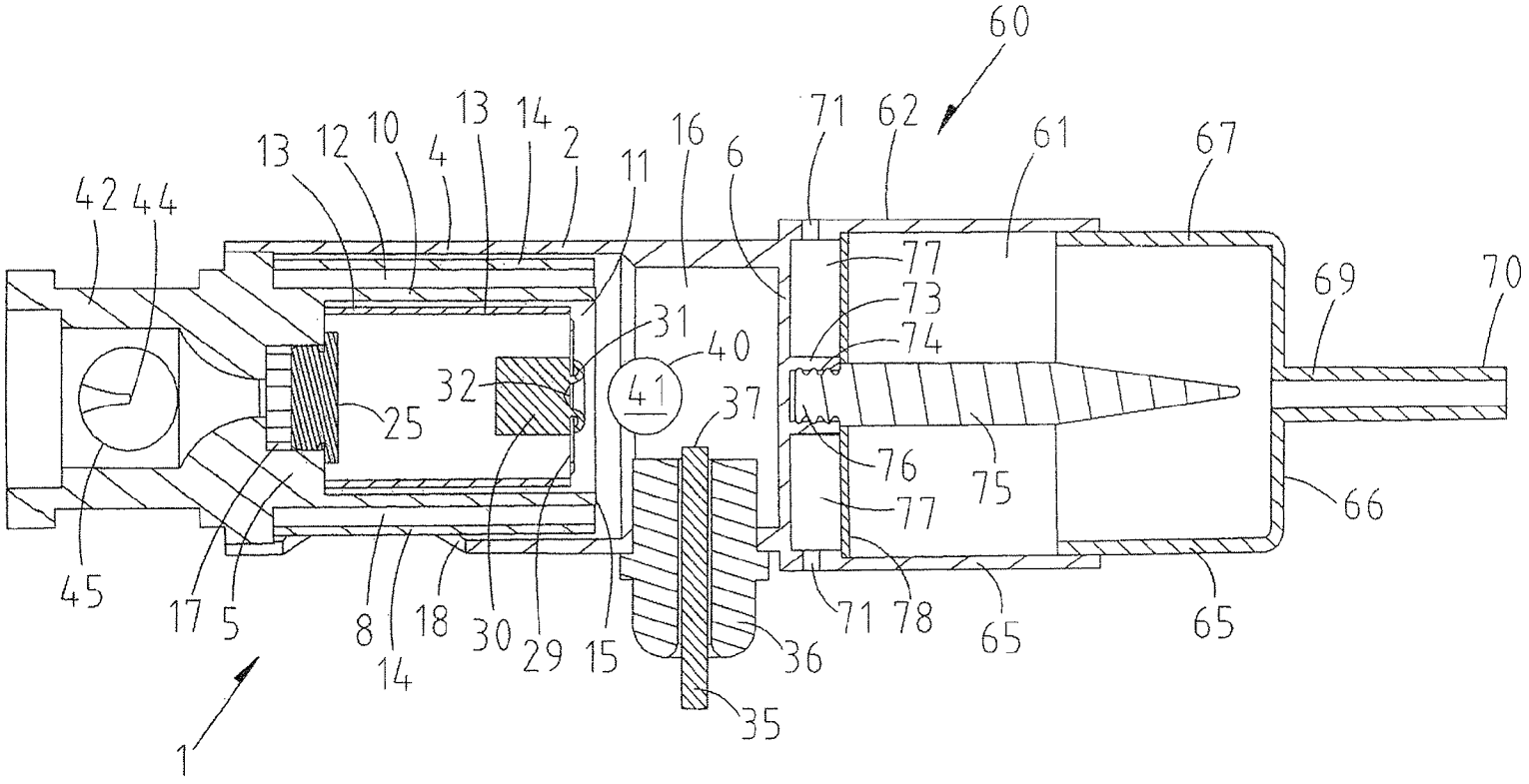
Figure 10:
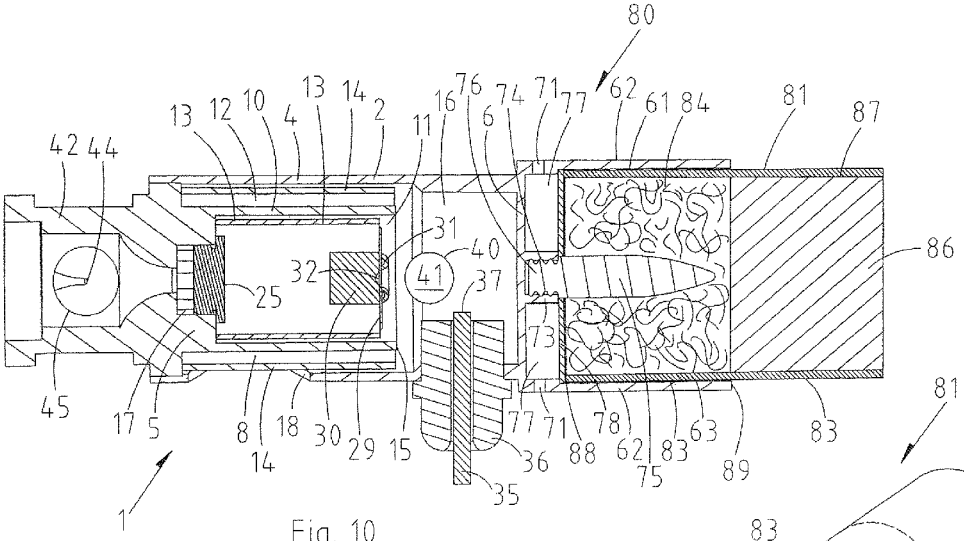
Figure 11:
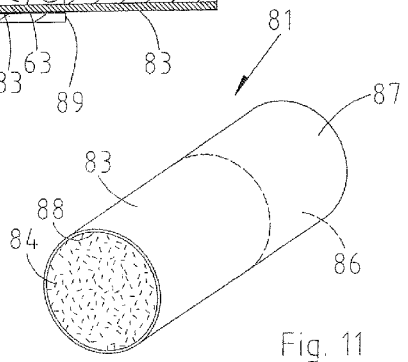

The invention will be more clearly understood from the following description of some preferred embodiments thereof, which are given by way of example only, with reference to the accompanying drawings, in which:

FIG. 1 is a transverse cross-sectional side elevational view of a gas powered heating unit according to the invention, FIG. 2 is a transverse cross-sectional end elevational view of the gas powered heating unit of FIG. 1 on the line II-II of FIG. 1, FIG. 3 is a transverse cross-sectional end elevational view of the gas powered heating unit of FIG. 1 on the line III-III of FIG. 1, FIG. 4 is a transverse cross-sectional end elevational view of the gas powered heating unit of FIG. 1 on the line IV-IV of FIG. 1, FIG. 5 is a schematic transverse cross-sectional side elevational view of a portion of the gas powered heating unit of FIG. 1, which details the fluid flow path through the combustion chambers, FIG. 6 is a schematic perspective view of a portion of the gas powered heating unit of FIG. 1, FIG. 7 is an enlarged transverse cross-sectional end view of the gas powered heating unit of FIG. 1, FIG. 8 is a transverse cross-sectional side elevational view of a vaporising device according to the invention for vaporising vaporisable matter, which includes the gas powered heating unit of FIG. 1, FIG. 9 is an end view of the vaporising device of FIG. 8 with a portion thereof removed, FIG. 10 is a transverse cross-sectional side elevational view of a vaporising device according to another embodiment of the invention for vaporising vaporisable matter, which includes the gas powered heating unit of FIG. 1, and FIG. 11 is a perspective view of an article containing vaporisable matter for use with the vaporising device of FIG. 10.

Referring to the drawings and initially to FIGS. 1 to 7 thereof, there is illustrated a gas powered heating unit according to the invention, indicated generally by the reference numeral 1, for converting fuel gas to heat by gas catalytic conversion action. The heating unit 1 is particularly suitable for miniaturisation, and is thus particularly suitable for use in a portable handheld heating device, such as a soldering iron, a glue gun, a clothes pressing iron and a vaporising device such as a heat not burn vaporising device for vaporising vaporisable matter. Vaporising devices according to the invention are described below with reference to FIGS. 8 to 11.

The heating unit 1, which comprises a housing 2 of heat conductive material, is a particularly efficient unit in converting fuel gas to heat by virtue of the housing 2 defining a first catalytic combustion chamber, namely, a cylindrical primary combustion chamber 11, a second catalytic combustion chamber, namely, an annular secondary combustion chamber 12, and a flame combustion chamber 16. Referring in particular to FIGS. 5 and 7, the secondary combustion chamber 12 extends around the primary combustion chamber 11, and a fuel gas/air mixture which is introduced into the primary combustion chamber 11 flows in the direction of the arrows A of FIGS. 5 and 6 through the primary combustion chamber 11 and in turn through the flame combustion chamber 16 to the secondary combustion chamber 12. A first catalytic element, namely, a cylindrical perforated primary gas catalytic combustion element 13, is located in the primary combustion chamber 11, and a second catalytic element, namely, a cylindrical perforated secondary gas catalytic combustion element 14 is located in the secondary combustion chamber 12. The primary and secondary gas catalytic combustion elements 13 and 14, as will be described below, are spaced apart from walls which define the primary and secondary combustion chambers 11 and 12, so that the fuel gas/air mixture which is introduced to the primary combustion chamber 11 flows along the inner and outer sides of the primary gas catalytic combustion element 13 in the direction of the arrows A, and in turn along inner and outer sides of the secondary gas catalytic combustion element 14 in the direction of the arrows A. Since the primary and secondary gas catalytic combustion elements 13 and 14 are of perforated material, as will be described below, the fuel gas/air mixture also flows through the primary and secondary gas catalytic combustion elements 13 and 14 between the inner and the outer sides of the respective elements 13 and 14.

Thus, when the primary and secondary gas catalytic combustion elements 13 and 14 have been brought to their ignition temperatures, the fuel gas/air mixture is efficiently converted to heat by the primary gas catalytic combustion elements 13, and exhaust gases with entrained unburnt fuel gas from the primary gas catalytic combustion chamber 11 flows in the direction of the arrows A through the flame combustion chamber 16, and in turn into the secondary combustion chamber 12, where the unburnt fuel gas is converted to heat by the secondary gas catalytic combustion element 14. This arrangement of the primary and secondary gas catalytic combustion elements 13 and 14 ensures that substantially all, if not all the fuel gas which passes through the primary and secondary combustion chambers 11 and 12 is converted to heat.

Initially in order to raise the temperature of the primary gas catalytic combustion element 13, the fuel gas/air mixture is burnt in a flame in the flame combustion chamber 16 as will be described below. The flame raises the temperature of the primary gas catalytic combustion element to its ignition temperature, which in turn commences to convert the fuel gas/air mixture to heat catalytically, and in turn starves the flame of fuel gas, which is extinguished. As the primary gas catalytic combustion element 13 commences to catalytically convert the fuel gas/air mixture to heat, the temperature of the housing 2 is raised, and in turn, by heat conduction, convection and radiation, the secondary gas catalytic combustion element 14 is raised to its ignition temperature, and it converts any unburnt fuel gas to heat which are entrained in the exhaust gases from the primary combustion chamber 11.

Turning now to the construction of the heating unit 1 in more detail, the housing 2, which is of heat conductive material, may be of aluminium, steel, stainless steel or any other suitable heat conducting material, and is formed by a main cylindrical side wall 4 which is closed at one end by a first end wall 5 and at the other end by a second end wall 6, which together define a main chamber 8. A partition element, which in this embodiment of the invention comprises a cylindrical partition wall 10 of similar material to that of the main side wall 4 extends from the first end wall 5 concentrically with the main side wall 4 into the main chamber 8, and divides the main chamber 8 into the primary combustion chamber 11 and the secondary combustion chamber 12. The primary combustion chamber 11 is formed within the partition wall 10, while the secondary combustion chamber 12 is defined between the partition wall 10 and the main side wall 4, so that the secondary combustion chamber 12 extends completely around and encompasses the primary combustion chamber 11. The primary gas catalytic combustion element 13 is located in the primary combustion chamber 11 for converting fuel gas therein to heat, and the secondary gas catalytic combustion element 14 is located in the secondary combustion chamber 12 also for converting fuel gas in the secondary combustion chamber 12 to heat.

The partition wall 10 terminates at a distal end 15 spaced apart from the second end wall 6, and defines with the second end wall 6 the flame combustion chamber 16, within which fuel gas is initially burnt in a flame to raise the temperature of the primary gas catalytic combustion element 13 to its ignition temperature in order to initiate catalytic conversion of the fuel gas to heat by the primary gas catalytic combustion element 13, and subsequently by the secondary gas catalytic combustion element 14, as will be described below. A fuel gas inlet 17 formed concentrically in the first end wall 5 delivers fuel gas into the primary combustion chamber 11. An exhaust gas outlet 18 in the main side wall 4 adjacent the first end wall 5 accommodates exhaust gases from the secondary combustion chamber 12.

The primary and secondary combustion chambers 11 and 12 communicate through the flame combustion chamber 16, and fuel gas delivered into the primary combustion chamber 11 through the fuel gas inlet 17 passes into the secondary combustion chamber 12 through the flame combustion chamber 16 in the direction of the arrows A, see FIGS. 5 and 6. Thus, when the temperature of the primary and secondary gas catalytic combustion elements 13 and 14 have been raised to their ignition temperature, fuel gas delivered into the primary combustion chamber 11 through the fuel gas inlet 17 is converted to heat by the primary gas catalytic combustion element 13, and exhaust gases with entrained unburnt fuel gas from the primary combustion element 11 passes through the flame combustion chamber 16 and in turn into the secondary combustion chamber 12 where the entrained unburnt fuel gas is converted to heat by the secondary gas catalytic combustion element 14. Exhaust gases from both the primary and secondary combustion chambers 11 and 12 pass through the exhaust gas outlet 18. The first end wall 5 thus defines the upstream end of the primary combustion chamber 11 and the downstream end of the secondary combustion chamber 12.

In this embodiment of the invention the primary gas catalytic combustion element 13 is of hollow cylindrical configuration formed by a sheet of perforated metal defining an inner catalytic surface 19 and an outer catalytic surface 20. The secondary gas catalytic combustion element 14 is also of hollow cylindrical configuration and is formed by a sheet of perforated metal defining an inner catalytic surface 21 and an outer catalytic surface 22. The primary gas catalytic combustion element 13 is configured relative to the partition wall 10 so that the inner and outer catalytic surfaces 19 and 20 define respective passageways 23 and 24 through the primary combustion chamber 11 so that fuel gas delivered through the fuel gas inlet 17 into the primary combustion chamber 11 passes along both the inner and outer catalytic surfaces 19 and 20 of the primary gas catalytic combustion element 13 in the direction of the arrows A, see FIGS. 5 and 6, for facilitating gas catalytic conversion of the fuel gas by the primary gas catalytic combustion element 13.

The secondary gas catalytic combustion element 14 is configured within the secondary combustion chamber 12 so that the inner and outer catalytic surfaces 21 and 22 thereof define passageways 26 and 27 through the secondary combustion chamber 12, through which the exhaust gases with entrained fuel gas from the primary combustion chamber 11 pass along over the inner and outer catalytic surfaces 21 and 22 of the secondary gas catalytic combustion element 14 in the direction of the arrows A, see FIGS. 5 and 6. Accordingly, fuel gas which is not converted to heat in the primary combustion chamber 11 on passing over the inner and outer catalytic surfaces 21 and 22 of the secondary gas catalytic combustion element 14 is converted to heat, thus heat extraction efficiency from the fuel gas is significantly increased by the combination of the primary and secondary gas catalytic combustion elements 13 and 14.

By passing the fuel gas over the inner and outer surfaces of the primary and secondary gas catalytic combustion elements 13 and 14, heat extraction efficiency of the primary and secondary gas catalytic combustion elements 13 and 14 is increased. Additionally, by virtue of the fact that the primary gas catalytic combustion element 13 is perforated, fuel gas as it passes along the passageways 23 and 24 in the primary combustion chamber 11 also permeates through the primary gas catalytic combustion element 13 between the passageways 23 and 24, thereby further increasing the conversion efficiency of the primary gas catalytic combustion element 13. Similarly, since the secondary gas catalytic combustion element 14 is perforated, fuel gas as it passes along the passageways 26 and 27 in the secondary combustion chamber 12 also permeates through the secondary gas catalytic combustion element 13 between the passageways 26 and 27, thereby increasing the conversion efficiency of the secondary gas catalytic combustion element 14.

A diffuser 25 located in the fuel gas inlet 17 directs fuel gas into the primary combustion chamber 11 and co-operates with the partition wall 10 to direct the fuel gas along the passageways 23 and 24 over the inner and outer catalytic surfaces 19 and 20 of the primary gas catalytic combustion element 13.

The primary gas catalytic combustion element 13 comprises a carrier provided by a hollow cylindrical carrier member 28 of a perforated sheet stainless steel/aluminium alloy. The carrier member 28 is coated with a precious metal alloy which is predominantly of platinum. The outer diameter of the first gas catalytic combustion element 13 is less than the internal diameter of the partition wall 10, so that the outer catalytic surface 20 thereof is spaced apart from the partition wall 10 to form the passageway 24 in order that fuel gas can pass along the outer catalytic surface 20 of the primary gas catalytic combustion element 13. An end cap 29 of a similar perforated carrier material to that of the carrier member 28 coated with a similar precious metal alloy to that with which the carrier member 28 is coated extends transversely across a downstream end of the carrier member 28. Accordingly, some unburnt fuel gas passing from the passageway 23 through the end cap 29 is converted to heat by the end cap 29, and any remaining fuel gas not converted to heat passes through the flame combustion chamber 16 into the secondary combustion chamber 12 along with exhaust gases from the primary combustion chamber 11.

A thermal mass 30 is secured to the end cap 29 of the primary gas catalytic combustion element 13 by a rivet 31 with the thermal mass 30 in heat conducting engagement with the end cap 29 for maintaining an adjacent portion 32 of the end cap 29 at or above its ignition temperature during short periods while delivery of fuel gas to the main chamber 8 is interrupted during temperature regulation of the housing 2, so that when delivery of fuel gas is re-established to the main chamber 8, the portion 32 of the end cap 29 is at or above its ignition temperature and commences to convert fuel gas to heat, thereby rapidly raising the remainder of the end cap 29, and in turn the carrier member 28 to the ignition temperature, so that the entire primary gas catalytic combustion element 13 converts fuel gas to heat.

The secondary gas catalytic combustion element 14 comprises a carrier of hollow cylindrical construction formed by a cylindrical carrier member 33 of perforated sheet stainless steel/aluminium alloy and coated with a precious metal alloy which is predominantly of platinum. The outer diameter of the secondary gas catalytic combustion element 14 is less than the inner diameter of the main side wall 4, and the inner diameter of the secondary gas catalytic combustion element 13 is greater than the outer diameter of the partition wall 10, in order to define the passageways 26 and 27 in the secondary combustion chamber 12, so that fuel gas flows over both the inner and outer catalytic surfaces 21 and 22 of the secondary gas catalytic combustion element 13.

In this embodiment of the invention the primary and secondary gas catalytic combustion elements 13 and 14 are of similar materials, and both have similar ignition temperatures, at which they commence to convert fuel gas to heat by catalytic action.

An electrode 35 in an electrically insulating housing 36 of ceramics material extends into the flame combustion chamber 16 with the insulating housing 36 electrically isolating the electrode 35 from the main side wall 4. The electrode 35 terminates in a tip 37, which is spaced apart from the main side wall 4, so that when a voltage is applied to the electrode 35 a spark arcs between the tip 37 and the main side wall 4 for initially igniting the fuel gas to burn in flame in the flame combustion chamber 16, for raising the temperature of the primary gas catalytic combustion element 13 to its ignition temperature. A piezoelectric igniter (not shown) is coupled to the electrode 35 for producing the voltage on the electrode 35. The main side wall 4 is held at ground voltage potential relative to that of the electrode 35.

The end cap 29 of the primary gas catalytic combustion element 13 being perforated permits fuel gas to permeate therethrough into the flame combustion chamber 16 when the fuel gas is initially delivered through the fuel gas inlet 15 into the primary combustion chamber 11. On a spark being established between the electrode 35 and the main side wall 4, the fuel gas is ignited to burn in a flame in the flame combustion chamber 16. The root of the flame sits just off the end cap 29 of the primary gas catalytic combustion element 13, and the flame is sufficiently close to the end cap 29 for raising the temperature of the end cap 29 to its ignition temperature. Once the end cap 29 has been raised to its ignition temperature, it immediately commences to convert fuel gas to heat by catalytic conversion, and the remainder of the end cap 29, and in turn the carrier member 28 of the primary gas catalytic element 13 is raised to its ignition temperature, which also converts the fuel gas to heat. At this stage the flame is starved of fuel gas and is extinguished. Thereafter, conversion of fuel gas to heat is carried out by catalytic conversion in the primary gas catalytic combustion element 13. The secondary gas catalytic combustion element 14 is then rapidly raised to its ignition temperature by heat radiation from the partition wall 10 and from the main side wall 4, as well as by the hot exhaust gases from the primary combustion chamber 11. On reaching its ignition temperature, the secondary gas catalytic combustion element 14 converts any fuel gas to heat not already converted to heat in the primary combustion chamber 11.

An inspection port 40 extending through the main side wall 4 is closed by a lens 41 to facilitate inspection of the flame combustion chamber 16 to determine the status of the flame.

A venturi mixer element 42 is located upstream of the first end wall 5 for mixing fuel gas with air prior to being delivered into the main chamber 8 through the fuel gas inlet 15. Fuel gas is delivered into the venturi mixer element 42 through a gas jet 44, and air for mixing with the fuel gas is drawn into the venturi mixer element 42 through an air inlet port 45.

Although not illustrated, a temperature control system is provided upstream of the venturi mixer 42 for controlling the temperature of the heating unit 1. The temperature control system comprises a temperature responsive valve which is in heat conducting engagement with the housing 2 of the heating unit 1. The temperature responsive valve in response to the temperature of the housing 2 controls the rate of delivery of fuel gas to the venturi mixer element 42 in order to maintain the temperature of the housing 2 within a predefined temperature range. The temperature responsive valve may gradually vary the supply of fuel gas to the venturi mixer element 42, or it may periodically interrupt fuel gas supply for short periods to the venturi mixer element 42, depending on the desired operating temperature of the heating unit 1. During such short periods of interruption of fuel gas to the venturi mixer element 42, the thermal mass 30 maintains the portion 32 of the primary gas catalytic combustion element 13 at its ignition temperature in order that catalytic conversion of fuel gas to heat by the primary gas catalytic combustion element 13 recommence on re-establishment of the fuel gas supply. Such a temperature control system may be similar to that described in the applicant's PCT published Application Specification No. WO 02/48591, and in the applicant's published PCT Application Specification No. WO 2006/082571.

In use, fuel gas is delivered through the gas jet 44 into the venturi mixer element 42 where the fuel gas is mixed with air and delivered through the diffuser 25 in the fuel gas inlet 17 into the primary combustion chamber 11. Initially, the fuel gas/air mixture is ignited by a spark from the electrode 35 to burn in a flame in the flame combustion chamber 16, in order to raise the temperature of the primary gas catalytic combustion element 13 to its ignition temperature to commence catalytic conversion of the fuel gas to heat by the primary gas catalytic combustion element 13. Once the primary gas catalytic combustion element 13 has reached its ignition temperature it commences to convert fuel gas to heat catalytically. Thereafter the flame is starved of fuel gas and is extinguished. As heat is conducted and radiated from the primary gas catalytic combustion element 13 to the partition wall 10 and the main side wall 4, the secondary gas catalytic combustion element 14 is raised to its ignition temperature also. As the fuel gas flows through the primary combustion chamber 11, a large proportion of the fuel gas is converted to heat by the primary gas catalytic combustion element 13. Exhaust gases with unburnt fuel gas entrained therein pass from the primary combustion chamber 11 through the flame combustion chamber 16 into the secondary combustion chamber 12. Unburnt fuel gas entrained in the exhaust gases is converted to heat by the secondary gas catalytic combustion element 14. Exhaust gases are exhausted from the secondary combustion chamber 12 through the exhaust gas outlet 18.

The flame combustion chamber 14 may be inspected through the inspection port 40, initially to establish that flame combustion has commenced in the flame combustion chamber 16, and to subsequently ensure that combustion has transitioned from flame combustion to catalytic conversion. During the transition, the flame reduces in size and intensity and progressively turns yellow. As the catalytic conversion commences, the primary and secondary gas catalytic combustion elements 13 and 14 commence to glow red, thus producing a red glow which is visible through the inspection port 40.

During short periods of fuel gas interruption, resulting from temperature regulation of the heating unit 1, the thermal mass 30 maintains the adjacent portion 32 of the primary gas catalytic combustion element 13 at or above its ignition temperature, so that when the fuel gas is re-established to the primary combustion chamber 11, the primary gas catalytic combustion element 13 again commences to convert the fuel gas to heat, thereby in turn raising the temperature of the secondary gas catalytic combustion element 14 to its ignition temperature, and thus normal operation of the heating unit 1 continues.

By virtue of the construction of the primary gas catalytic combustion element 13, the primary gas catalytic combustion element 13, and in particular the end cap 29 of the primary gas catalytic combustion element 13 acts to prevent migration of the flame during flame combustion from the flame combustion chamber 16 into the primary combustion chamber 11, thereby avoiding blow-back of the flame which could in turn migrate into the fuel gas inlet 17 and to the venturi mixer 42, and would lead to an explosion. The provision of the secondary gas catalytic combustion element 14 in the secondary combustion chamber 12 prevents migration of the flame during flame combustion from the flame combustion chamber 16 through the secondary combustion chamber 12, which could otherwise result in blow-out of the flame through the exhaust gas outlet 18, which could lead to injury or burning of an individual using the heating unit 1. Indeed, the fact that the secondary gas catalytic combustion element 14 extends over the exhaust gas outlet 18 further acts to prevent blow-out of the flame through the exhaust gas outlet 18. Accordingly, the arrangement of the primary and secondary gas catalytic combustion elements 20 and 21 act to confine the flame in the flame combustion chamber 16 during flame combustion.

Referring now to FIGS. 8 and 9, there is illustrated a vaporising device also according to the invention, which is indicated generally by the reference numeral 60. The vaporising device 60 is a heat not burn vaporising device for vaporising vaporisable constituents of vaporisable matter, for example, tobacco and/or other such herb and plant matter. The vaporisable matter is vaporised by heating only without burning of the vaporisable matter. In this embodiment of the invention the vaporising device 60 is particularly suitable for vaporising tobacco. The vaporising device 60 comprises the gas powered heating unit 1 described with reference to FIGS. 1 to 7. The heating unit acts as a heat source for heating the vaporisable matter in a vaporisation chamber 61, which is formed by a secondary cylindrical side wall 62 extending from the second end wall 6 of the heating unit 1. The heating unit 1 in this embodiment of the invention is similar to the heating unit 1 described with reference to FIGS. 1 to 7, and similar components are identified by the same reference numerals.

The secondary side wall 62 is of heat conductive material similar to that of the housing 2, and defines an open mouth 63 to the vaporisation chamber 61. A hollow cylindrical plug member 65 is engageable in the vaporisation chamber 61 for closing the open mouth 63, and in turn the vaporisation chamber 61. The plug member 65 comprises an end wall 66 and a cylindrical side wall 67 extending from the side wall 66 which forms a relatively tight sliding fit within the secondary side wall 62. An outlet tube 69 extends coaxially from the end wall 66 of the plug member 65 and terminates in a mouthpiece 70 for accommodating an aerosol of the vapours vaporised from the vaporisable matter in the vaporisation chamber 61 through the mouthpiece 70.

One or more air inlet ports 71 in the secondary side wall 62 adjacent the second end wall 6 accommodate air being drawn into the vaporisation chamber 61 for in turn facilitating drawing of the aerosol of the vapours from the vaporisation chamber 61 through the mouthpiece 70. As the mouthpiece 70 is drawn on, air drawn through the air inlet ports 71 entrain vapours of the vaporisable constituents released from the vaporisable matter in the vaporisation chamber 61, so that as the vapours cool in the outlet tube 69, the aerosol is formed, and in turn drawn through the mouthpiece 70.

A central boss 73 having a threaded central bore 74 is integrally formed with and extends from the second end wall 6 into the vaporisation chamber 61. A heat exchange element, namely, a heat exchange spindle 75 terminating in a threaded end 76 is engageable in the threaded bore 74 and extends coaxially from the boss 73 into and through the vaporisation chamber 61 for transferring heat from the second end wall 6 into the vaporisable matter in the vaporisation chamber 61. The heat exchange spindle 75 is of heat conductive material similar to that of the housing 2 and is concentric with the secondary side wall 62. A plurality of spacing fins 77 extend from the second end wall 6 and radially from the boss 73 for spacing a disc 78 of metal gauze material from the second end wall 6. The disc 78 is of diameter substantially similar to that of the vaporisation chamber 61 for retaining vaporisable material in the vaporisation chamber 61 and preventing the vaporisable material passing through the air inlet ports 71. Additionally, the gauze disc 78 accommodates air therethrough, and diffuses the air drawn in through the air inlet ports 71 over the area of the vaporisable matter in the vaporisation chamber 61.

The vaporisation chamber 61 is substantially similar to the vaporisation chamber of the vaporising device disclosed in the applicant's PCT Application No. WO 2006/082571.

A temperature responsive control valve (not shown) located upstream of the venturi element 42 which is in heat conductive engagement with the housing 2 through the first end wall 5 is responsive to the temperature of the housing 2, and in turn the temperature of the vaporisation chamber 61 for controlling the supply of fuel gas to the venturi mixer element 42 for maintaining the temperature of the vaporisable matter in the vaporisation chamber 61 at an appropriate vaporising temperature, which for vaporising desirable constituents from tobacco typically lies in the range of 100° C. to 350° C., and more typically in the range of 130° to 250° C., and ideally in the range of 150° C. to 200° C. The temperature responsive valve is of the type disclosed in PCT published Application Specifications Nos. WO 02/48591 and WO 2006/082571 of the present applicant. Additionally, a safety isolation valve may also be provided upstream of the temperature responsive control valve for isolating the heating unit 1 from a fuel gas supply in the event of the heating unit 1 exceeding a safe temperature. Such a safety isolating valve may be of the type disclosed in connection with the vaporising device disclosed in PCT published Application Specification No. WO 2006/082571 of the applicant.

Typically, the vaporising device 60 comprising the housing 2 and the vaporisation chamber 61, as well as the temperature responsive control valve and the safety isolation valve are housed in a casing, typically of plastics material, and a refillable reservoir is provided in the casing for supplying fuel gas to the heating unit 1 through the safety isolating valve and the temperature responsive valve.

In use, tobacco to be vaporised is placed in the vaporisation chamber 61. The tobacco may be in particulate and/or flake form, in loose form, or in a sachet. Alternatively, instead of providing tobacco, a cartridge comprising a nicotine infused matrix may be placed in the vaporisation chamber 61. Where the tobacco is provided in a sachet, the sachet may be of any desirable shape, and in certain cases, may be of cylindrical shape. With the tobacco or nicotine infused matrix cartridge placed in the vaporisation chamber 61, the plug member 65 is engaged in the vaporisation chamber 61 for closing the vaporisation chamber 61.

A manual on/off valve (not shown) is operated for supplying fuel gas from the reservoir (not shown) to the heating unit 1. Simultaneously with operating the manual on/off valve, the piezoelectric igniter (not shown) is activated for applying a high voltage to the electrode 35, which causes a spark to arc between the tip 37 of the electrode 35 and the main side wall 4 of the housing of the heating unit 1, which in turn ignites the fuel gas/air mixture from the venturi mixer element 42 to burn in the flame combustion chamber 16 with flame combustion. The flame raises the temperature of the primary gas catalytic combustion element 13 to its ignition temperature, which commences to convert fuel gas to heat, and shortly thereafter the flame is starved of fuel gas, and is extinguished. The secondary gas catalytic combustion element 14 is then brought up to its ignition temperature and converts the fuel gas entrained in the exhaust gases from the primary combustion chamber 11 to heat. When the housing 2 has been brought up to its operational temperature, and the tobacco in the vaporisation chamber 61 commences to produce a vapour of the vaporisable components therein, by drawing on the mouthpiece 70, an aerosol of the vapours produced from the tobacco drawn from the vaporisation chamber 61 is formed and is drawn through the mouthpiece 70 for inhaling thereof.

When the vaporisable constituents have been exhausted in the tobacco, the spent tobacco is removed from the vaporisation chamber 61 and replaced with fresh tobacco.

Referring now to FIGS. 10 and 11, there is illustrated a vaporising device according to another embodiment of the invention, indicated generally by the reference numeral 80 for vaporising vaporisable components in tobacco of a tobacco product 81. The vaporising device 80 is substantially similar to the vaporising device 60 and similar components are identified by the same reference numerals. The main difference between the vaporising device 80 and the vaporising device 60 is that the vaporisation chamber 66 is adapted to receive the tobacco product 81, which is of cylindrical configuration, and which is engageable with a tight sliding fit in the vaporisation chamber 61. Accordingly, the plug member 65 is omitted in this embodiment of the invention. The tobacco product 81 comprises an outer cylindrical sleeve 83 of a suitable paper, within which tobacco 84 in particulate and flake form is packed. A filter element 86 is located in the sleeve 83 at a downstream end 87 thereof. The filter element 86 is similar to a conventional cigarette end filter, and is provided for filtering out various constituents from the vapours vaporised from the vaporisable constituents in the tobacco 84, and also for creating condensation of the vapours to form the aerosol.

An upstream end 88 of the sleeve 83 is open for accommodating air into the tobacco 84 in the sleeve 83. The sleeve 83 is of outer diameter substantially similar to the inner diameter of the vaporisation chamber 61, and is a relatively tight sliding fit in the secondary side wall 62.

Although the vaporising device 80 is illustrated comprising a heat exchange spindle 75, the vaporising device 88 may be provided with or without the heat exchange spindle 75. However, if provided in the vaporising device 80, the heat exchange spindle 75 would penetrate axially through the centre of the tobacco 84 in the sleeve 83 as the sleeve 83 is being inserted into the vaporisation chamber 61.

In this embodiment of the invention the length of the portion of the sleeve 83 which is packed with the tobacco 84 is of similar length to the length of the secondary side wall 62 from the gauze disc 78 to a downstream end 89 of the secondary side wall 62, so that when the sleeve 83 is inserted into the vaporisation chamber 61 with the upstream end 88 thereof abutting the gauze disc 78, the tobacco 84 is located totally within the vaporisation chamber 61 with the filter element 86 projecting outwardly therefrom for facilitating drawing on the sleeve 83 adjacent the filter element 87.

In use, the tobacco product 81 is inserted into the vaporisation chamber 61 by inserting the sleeve 83 into the vaporisation chamber 61 until the upstream end 88 thereof is in tight abutting engagement with the gauze disc 78, and if the heat exchange spindle 75 is provided in the vaporisation chamber 61, the heat exchange spindle 75 penetrates through the tobacco 84 as the tobacco product is being inserted into the vaporisation chamber 61. When the vaporising device 80 has been brought up to the operational temperature and the vaporisable constituents of the tobacco 84 commence to vaporise, by drawing on the downstream end 87 of the sleeve 83 adjacent the filter element 86, an aerosol of the vaporisable constituents is drawn through the filter element 86 for inhaling.

While the heating unit has been described for heating a vaporisation chamber of a vaporising device, it will be readily apparent to those skilled in the art that the heating unit 1 according to the invention may be used for heating any other accessory, for example, a soldering tip of a soldering iron, a glue gun, a pressing plate of a clothes pressing iron, or any other element which is to be heated. When the heating unit is provided for heating a soldering tip of a soldering iron, it is envisaged that the soldering tip would be located in place of the secondary side wall 62 which forms the vaporisation chamber, and would extend axially from the second end wall 6. When the heating device is provided for heating a glue gun, it is envisaged that the heating unit would be located within a heat conductive housing which would in turn be provided with a glue accommodating bore for accommodating glue to be melted, and in turn urged through a glue nozzle extending from the heat conductive element. When the heating unit is provided for heating a pressing plate of a clothes pressing iron, the housing of the heating unit would be provided in direct heat conductive engagement with the pressing plate of the clothes pressing iron.

It will be appreciated that while the heating unit 1 has been described as comprising a housing of a particular shape and construction for forming the combustion chambers, housings of any other suitable shape and construction may be used.

It will also be appreciated that primary and secondary gas catalytic combustion elements of other shape and construction and indeed, of other materials may be used. It is envisaged in certain cases that primary and secondary gas catalytic combustion elements of ceramics material may be provided, and in certain cases, it is envisaged that one of the primary and secondary gas catalytic combustion elements may be of ceramics material, while the other may be of a metal material. Indeed, in certain cases, it is envisaged that the primary gas catalytic combustion element may be of ceramics material, and could be provided by a porous block or a cylinder of ceramics material, which would be located in the primary combustion chamber. The ceramics material of the primary gas catalytic combustion element could be made porous by providing a plurality of interconnected voids within the ceramics material, or providing a plurality of relatively small diameter bores extending therethrough.

While the primary and secondary gas catalytic combustion elements have been described as being of materials similar to each other and having respective similar ignition temperatures, it is envisaged that in certain cases, the primary and secondary gas catalytic combustion elements may be different to each other, and may have different ignition temperatures. For example, it is envisaged in certain cases that the secondary gas catalytic combustion element may have a lower ignition temperature than the primary gas catalytic combustion element, or vice versa.

While the vaporising device has been described for vaporising tobacco, the vaporising device may be used for vaporising any other vaporisable matter, whether herb, plant or other matter, as well as medicinal compounds, compositions and constituents and psychoactive compounds, compositions and constituents.

While the vaporisation chamber has been described as comprising a single heat exchange spindle extending into the vaporisation chamber, it will be readily apparent that any number of heat exchange spindles may be provided. It is also envisaged in certain cases that the heat exchange spindles may be omitted.

While a particular construction of vaporisation chamber has been described, any other suitable arrangement of vaporisation chamber, and a vaporisation chamber with any other suitable relationship to the vaporisable matter to be vaporised may be provided.

Indeed, in certain cases, it is envisaged that the heating device may be provided as a disposable device which after use with, for example, a predetermined number of tobacco products or sachets of tobacco, or charges of tobacco in the vaporisation chamber, the vaporising device may be disposed of. In which case, the fuel gas reservoir would not be refillable, and would be provided with just sufficient fuel gas for the number of tobacco products or charges of tobacco for which the device is intended to be used.

It is also envisaged that in certain cases, the heating unit may be provided without a flame combustion chamber. In which case, it is envisaged that the secondary gas catalytic combustion element would be raised to its ignition temperature by initially igniting the fuel gas/air mixture exiting through the exhaust gas outlet to burn in a flame, and the root of the flame sitting on the secondary catalytic combustion element would raise the secondary catalytic combustion element to its ignition temperature, which would thus commence to convert the fuel gas to heat by catalytic action, thus extinguishing the flame, and in turn transferring heat by radiation to the primary gas catalytic combustion element, which in turn would be raised to its ignition temperature.

Needless to say, any other suitable ignition system may be provided for igniting the fuel gas to burn in a flame in order to raise the temperature of either of the gas catalytic combustion elements to their ignition temperature. Indeed, it is envisaged that in certain cases, where the flame combustion chamber has been omitted, the primary combustion chamber and the primary gas catalytic combustion element may be arranged whereby flame combustion initially takes place within the primary gas catalytic combustion element, which on being brought up to its ignition temperature commences to convert fuel gas to heat, thus extinguishing the flame.

The invention claimed is:

1. A gas powered heating unit comprising:

a housing of heat conductive material comprising:

a first catalytic combustion chamber, a second catalytic combustion chamber extending around the first catalytic combustion chamber, and a flame combustion chamber communicating the second catalytic combustion chamber with the first catalytic combustion chamber, a first catalytic element located in the first catalytic combustion chamber, a second catalytic element located in the second catalytic combustion chamber, a fuel gas inlet to the first catalytic combustion chamber, and an exhaust gas outlet from the second catalytic combustion chamber, the fuel gas inlet and the exhaust gas outlet being disposed relative to the first and second catalytic combustion chambers so that fuel gas from the fuel gas inlet flows initially through the first catalytic combustion chamber along the first catalytic element where at least some of the fuel gas is converted to heat, and exhaust gases resulting from conversion in the first catalytic combustion chamber and unburnt fuel gas from the first catalytic combustion chamber flow from the first catalytic combustion chamber through the flame combustion chamber into the second catalytic combustion chamber and along the second catalytic element in the second catalytic combustion chamber where the unburnt fuel gas is converted to heat, and the exhaust gases resulting from conversion in the first and second catalytic combustion chamber exit through the exhaust gas outlet, wherein the first catalytic element comprises:

a first hollow cylindrical carrier member, and an end cap extending transversely across the first hollow cylindrical carrier member adjacent a downstream end thereof, the first hollow cylindrical carrier member and the end cap being of perforated material coated with a gas catalytic material, the first catalytic element is located in the first catalytic combustion chamber with the end cap adjacent the flame combustion chamber and is configured therein so that fuel gas passing through the first catalytic combustion chamber through the first hollow cylindrical carrier member of the first catalytic element passes through the end cap, so that as fuel gas is initially burnt in a flame in the flame combustion chamber, the flame raises the temperature of the end cap to the ignition temperature of the catalytic material coated thereon, which commences to convert fuel gas to heat and thereby extinguish the flame, and the first catalytic element and the perforated end cap is configured to act as a barrier to prevent blowback of flame from the flame combustion chamber through the fuel gas inlet.

2. A gas powered heating unit as claimed in claim 1 in which the first catalytic combustion chamber comprises a cylindrical, chamber.

3. A gas powered heating unit as claimed in claim 1 in which the first catalytic element is configured to define two catalytic surfaces, and the first catalytic combustion chamber comprises two fuel flow passages formed by the catalytic surfaces of the first catalytic element.

4. A gas powered heating unit as claimed in claim 1 in which the second catalytic element is formed as a cylindrical element within the second catalytic combustion chamber.

5. A gas powered heating unit as claimed in claim 1 in which the second catalytic element is configured to define two catalytic surfaces, and the second catalytic combustion chamber comprises two fuel flow passages formed by the catalytic surfaces of the second catalytic element.

6. A gas powered heating unit as claimed in claim 1 in which the housing comprises a main side wall extending around and defining a main chamber within which the first and second catalytic combustion chambers are formed, the main side wall extending between a first end wall closing one end of the main chamber, and a second end wall closing the other end of the main chamber, the first end wall defining an upstream end of the first catalytic combustion chamber, and a downstream end of the second catalytic combustion chamber, the fuel gas inlet being located in the first end wall, and the exhaust gas outlet being located in the main side wall adjacent the first end wall.

7. A gas powered heating unit as claimed in claim 6 in which a partition wall is located in the main chamber dividing the main chamber into the first catalytic combustion chamber and the second catalytic combustion chamber, the partition wall extending from the first end wall concentric with and spaced apart from the main side wall, and terminating in a distal end in the main chamber at a location spaced apart from the second end wall, the flame combustion chamber being defined between the second end wall and the distal end of the partition wall, the first catalytic combustion chamber being formed within the partition wall, and the second catalytic combustion chamber being formed between the partition wall and the main side wall.

8. A gas powered heating unit as claimed in claim 1 further comprising a temperature regulating valve configured to dispense fuel so as to maintain the housing within a predefined temperature range, and a thermal mass is associated with the first catalytic element for maintaining a portion of the first catalytic element at or above its ignition temperature adjacent the thermal mass during short periods of fuel gas interruption, so that when fuel gas is re-established, the portion of the first catalytic element adjacent the thermal mass commences to convert the fuel gas to heat.

9. A gas powered heating unit as claimed in claim 1 in which the second catalytic element is located relative to the exhaust gas outlet to act as a barrier to prevent blow-out of a flame from the flame combustion chamber through the exhaust gas outlet.

10. A vaporising device comprising a housing, the housing being of heat conductive material and comprising:

a vaporisation chamber for holding a vaporisable material configured to release an aerosol when heated, a first catalytic combustion chamber, a second catalytic combustion chamber, extending around the first catalytic combustion chamber, and a flame combustion chamber communicating the second catalytic combustion chamber with the first catalytic combustion chamber, a first catalytic element located in the first catalytic combustion chamber, a second catalytic element located in the second catalytic combustion chamber, a fuel gas inlet to the first catalytic combustion chamber, an exhaust gas outlet from the second catalytic combustion chamber, the fuel gas inlet and the exhaust gas outlet being disposed relative to the first and second catalytic combustion chambers so that fuel gas from the fuel gas inlet flows initially through the first catalytic combustion chamber along the first catalytic element where at least some of the fuel gas is converted to heat, and exhaust gases resulting from conversion in the first catalytic combustion chamber and unburnt fuel gas from the first catalytic combustion chamber flow from the first catalytic combustion chamber through the flame combustion chamber into the second catalytic combustion chamber and along the second catalytic element in the second catalytic combustion chamber where the unburnt fuel gas is converted to heat, and the exhaust gases resulting from conversion in the first and second catalytic combustion chamber exit through the exhaust gas outlet, wherein the first catalytic element comprises:

a first hollow cylindrical carrier member, and an end cap extending transversely across the first hollow cylindrical carrier member adjacent a downstream end thereof, the first hollow cylindrical carrier member and the end cap being of perforated material coated with a gas catalytic material, the first catalytic element is located in the first catalytic combustion chamber with the end cap adjacent the flame combustion chamber and is configured therein so that fuel gas passing through the first catalytic combustion chamber through the first hollow cylindrical carrier member of the first catalytic element passes through the end cap, so that as fuel gas is initially burnt in a flame in the flame combustion chamber, the flame raises the temperature of the end cap to the ignition temperature of the catalytic material coated thereon, which commences to convert fuel gas to heat and thereby extinguish the flame, and the first catalytic element and the perforated end cap is configured to act as a barrier to prevent blowback of flame from the flame combustion chamber through the fuel gas inlet.

11. A vaporising device as claimed in claim 10 in which the first catalytic element is configured to define two catalytic surfaces, and the first catalytic combustion chamber comprises two fuel flow passages formed by the catalytic surfaces of the first catalytic element.

12. A vaporising device as claimed in claim 10 in which the second catalytic element is configured to define two catalytic surfaces, and the second catalytic combustion chamber comprises two fuel flow passages formed by the catalytic surfaces of the second catalytic element.

13. A vaporising device as claimed in claim 10 in which the housing comprises a main side wall extending around and defining a main chamber within which the first and second catalytic combustion chambers are formed, the main side wall extending between a first end wall closing one end of the main chamber, and a second end wall closing the other end of the main chamber, the first end wall defining an upstream end of the first catalytic combustion chamber, and a downstream end of the second catalytic combustion chamber, the fuel gas inlet being located in the first end wall, and the exhaust gas outlet being located in the main side wall adjacent the first end wall.

14. A vaporising device as claimed in claim 13 in which a partition wall is located in the main chamber dividing the main chamber into the first catalytic combustion chamber and the second catalytic combustion chamber, the partition wall extending from the first end wall concentric with and spaced apart from the main side wall, and terminating in a distal end in the main chamber at a location spaced apart from the second end wall, the flame combustion chamber being defined between the second end wall and the distal end of the partition element the first catalytic combustion chamber being formed within the partition wall, and the second catalytic combustion chamber being formed between the partition wall and the main side wall.

15. A vaporising device as claimed in claim 10 in which the second catalytic element is located relative to the exhaust gas outlet to act as a barrier to prevent blow-out of a flame from the flame combustion chamber through the exhaust gas outlet.

16. A vaporising device as claimed in claim 10 further comprising a temperature regulating valve configured to dispense fuel so as to maintain the vaporisation chamber within a predefined temperature range, and a thermal mass is associated with the first catalytic element for maintaining a portion of the first catalytic element at or above its ignition temperature adjacent the thermal mass during short periods of fuel gas interruption, so that when fuel gas is re-established, the portion of the first catalytic element adjacent the thermal mass commences to convert the fuel gas to heat.

17. A vaporising device as claimed in claim 10 in which the vaporisation chamber is coaxial with the first and second catalytic combustion chambers.

18. A vaporising device as claimed in claim 13 in which the vaporisation chamber is formed by a secondary side wall extending from the second end wall, the secondary side wall being configured as a cylindrical side wall.

19. A vaporising device as claimed in claim 10 further comprising a hollow cylindrical plug member for engaging the vaporisation chamber, and an axial mouthpiece extending from the plug member.

20. A vaporising device as claimed in claim 10 in which the vaporisation chamber is configured to engage a tobacco product configured with tobacco, the tobacco product being configured with a filter mouthpiece.

21. A vaporising device as claimed in claim 10 further comprising a vaporisation module, wherein the module is configured as one of loose tobacco, tobacco flakes, a tobacco sachet and a cartridge comprising a matrix infused with nicotine.

* * * * *